United States Patent [19]

Wright

[11] Patent Number: 5,076,035

[45] Date of Patent: Dec. 31, 1991

[54] CHANNEL ASSEMBLY FOR MOUNTING BUILDING PANELS

[76] Inventor: John T. Wright, 19 Kratz Rd., R.D. #1, Harleysville, Pa. 19438

[21] Appl. No.: 588,193

[22] Filed: Sep. 26, 1990

[51] Int. Cl.[5] ..... E04C 2/40

[52] U.S. Cl. ..... 52/464; 52/489

[58] Field of Search ..... 52/400, 403, 460, 461, 52/462, 463, 464, 465, 468, 470, 489, 747

[56] References Cited

U.S. PATENT DOCUMENTS

| | | | |
|---|---|---|---|
| 3,138,229 | 6/1964 | Hubbard | 52/207 |
| 3,175,848 | 3/1965 | Mann | 52/119 |
| 3,553,915 | 1/1971 | Passovoy | 52/241 |
| 3,699,735 | 10/1972 | Smith | 52/400 |
| 3,868,802 | 3/1975 | Schubach . | |
| 4,936,065 | 6/1990 | Hutchinson | 52/465 |

*Primary Examiner*—Richard E. Chilcot, Jr.
*Assistant Examiner*—Kien Nguyen
*Attorney, Agent, or Firm*—Evelyn M. Sommer

[57] ABSTRACT

A channel assembly for mounting exterior panels on a structural member of a building has extruded support members which cooperate with a filler strip. The support members have grooves for holding the peripheral edges of respective panels to be mounted adjacent each other spaced apart by an intermediate space, and projections from opposite sides into the intermediate space. A filler strip is pressed into the intermediate space in sealing engagement with the projections. The support members have linking members with ends extending into the intermediate space closely adjacent each other, and mounting washers or a ledger strip are used to secure the ends of the linking members together and to mount them to a structural member of a building. The filler strip may be a V-shaped snap-in strip having a spine portion and a pair of compressible legs, or a compressible strip or tube which is pushed into the intermediate space and sealed therein with caulking.

10 Claims, 3 Drawing Sheets

CHANNEL ASSEMBLY FOR MOUNTING BUILDING PANELS

FIELD OF INVENTION

The invention relates to a channel assembly for mounting exterior panels on structural members of a building.

BACKGROUND ART

Generally, a channel assembly for mounting exterior panels on structural members of a building must have four basic characteristics: (1) load carrying capability to support the panels without substantial deformation; (2) adjustability to facilitate attachment of the panels to the structural members; (3) tight sealing to minimize infiltration of wind, rain, snow, hail and the like; and (4) removability to allow removal of any panel and/or seal member without disturbing others.

Attempts to satisfy the above-mentioned characteristics have been made in the prior art. However, none of them satisfy all four characteristics. For instance, a structure for a channel assembly shown in U.S. Pat. No. 3,175,848 to Jordan, issued Feb. 13, 1973, provides a rigid displaceable covering ledge to bridge or close the separation joints between the edges of adjacent exterior panels. However, this assembly does not have a satisfactory quality to prevent water intrusion, as there is space for water to penetrate between the edges of the adjacent panels. The patent discloses the idea of locally or continuously filling the separation joints with an elastic or plastic material to provide a sealing function. However, the sealing member does not allow for convenient removal of a panel without disturbing others.

Another attempt to prevent damage to exterior panels from water intrusion or pollutant corrosion is shown in U.S. Pat. No. 3,699,735 to Smith, issued Oct. 24, 1972, which relies upon the internal strength of resilient gaskets having an H-shaped cross-section for providing structural strength for supporting the weight of the panels as well a providing sealing capability. Variations of such gaskets employed as filler strips or wedges insertable in grooves as the sealing member are also illustrated in U.S. Pat. No. 3,138,229 to Hubbard, issued June 23, 1964. However, the prior structures do not allow for convenient removal of the exterior panels and/or the gaskets without disturbing others.

Accordingly, it is a broad object of the invention to provide an improved channel assembly for mounting panels on structural members of a building which satisfy all four desireable characteristics mentioned above.

A more specific object of the invention is to provide an improved channel assembly with sufficient sealing capability to prevent damage by water intrusion or pollutant corrosion, while at the same time allowing the panels and/or sealing members to be easily removed without disturbing others.

Another object of the invention is to provide an improved channel assembly which can be economically manufactured and is readily installed and adjusted. A further object is to provide a channel assembly with an esthetically attractive appearance.

SUMMARY OF INVENTION

In accordance with the present invention, a channel assembly has extruded support members which cooperate with a filler strip. The extruded support members each have a panel holding groove formed therein. The support members have their panel holding grooves engaged with a peripheral edge of a respective exterior panel. Two panels are mounted adjacent each other by positioning the support members spaced apart by an intermediate space facing oppositely from each other. The support members each have a top wall and a bottom wall which defines the respective groove, and a connecting element provided with a projection projecting from a respective side into the intermediate space between the adjacent exterior panels. The bottom element of each support member includes a linking member which extends from a respective side into the intermediate space closely adjacent that of the other support member. A mounting element secures the linking members of the respective support members in position and mounts them and the panels supported therein to a structural member of a building. The mounting element may be individual washers, e g. Belleville washers, or may be a clamping strip with a line of screw holes for securing along the length of the extruded support members.

The filler strip is dimensioned to be sealingly engaged with the support member projections in the intermediate space. Preferably, it is formed as a snap-in strip in a V-shape with a spine portion and a pair of compressible legs, each of which has a foot at the end thereof for engaging the respective projections of the connecting elements by the elastic force of the legs, in order to seal the intermediate space and prevent water or pollutants from leaking into the space between the panels or the walls of the building. The filler strip may also be a compressible tube or strip which is caulked in between the support members.

When the panels are to be removed or replaced, the filler strip is removed from the intermediate space, the mounting element is loosened, and the support members are flexibly moved by sliding or pivoting to allow easy removal of a panel without disturbing others. A cover ledger and isolation ledger are placed on opposite sides of the linking member and mounted therewith in a redundant sealing arrangement on the structural member of the building.

The foregoing and other features and advantages of the invention will be better understood from the following description when taken in conjunction with the drawings, in which:

DETAILED DESCRIPTION OF INVENTION

Figure 1A:
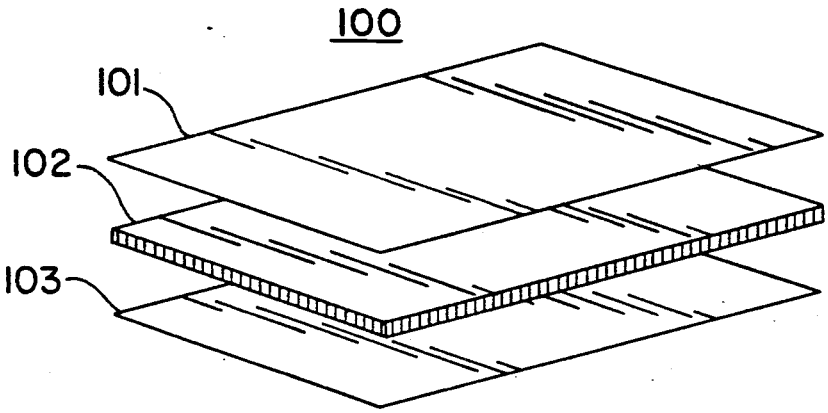
FIG. 1A is an exploded view of a three-layer exterior panel of fire-resistive construction.
Figure 1B:
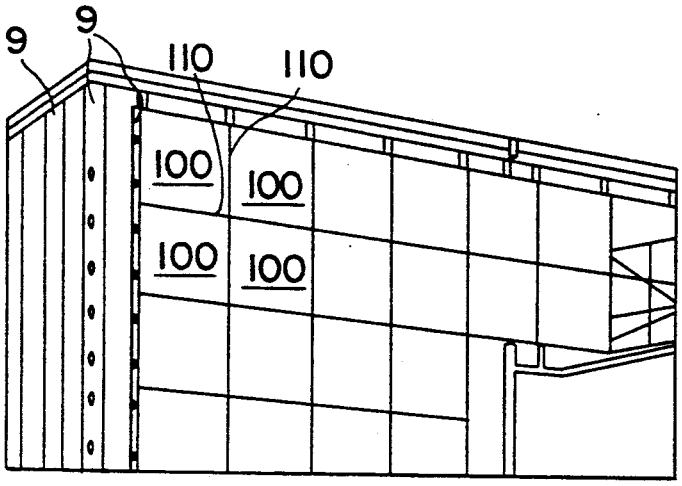
FIG. 1B illustrates the mounting of such panels on structural members of a building.

The channel assembly of the invention is used to mount exterior panels onto the underlying structural members (e.g. studs) of a building. The exterior panels 100 may be of the multiple-layer, fire-resistive type, as shown in FIG. 1A, having a prefinished aluminum face 101, a fiber-reinforced ceramic layer 102, and an aluminum back 103. Since the non-combustible ceramic layer 102 may absorb water, the panels must be well sealed, otherwise damage to the aluminum layers by "backside corrosion" may result. In FIG. 1B the exterior panels 100 are shown mounted by channel assemblies 110 to structural members (studs) 9 to form a building wall.

Figure 2A:
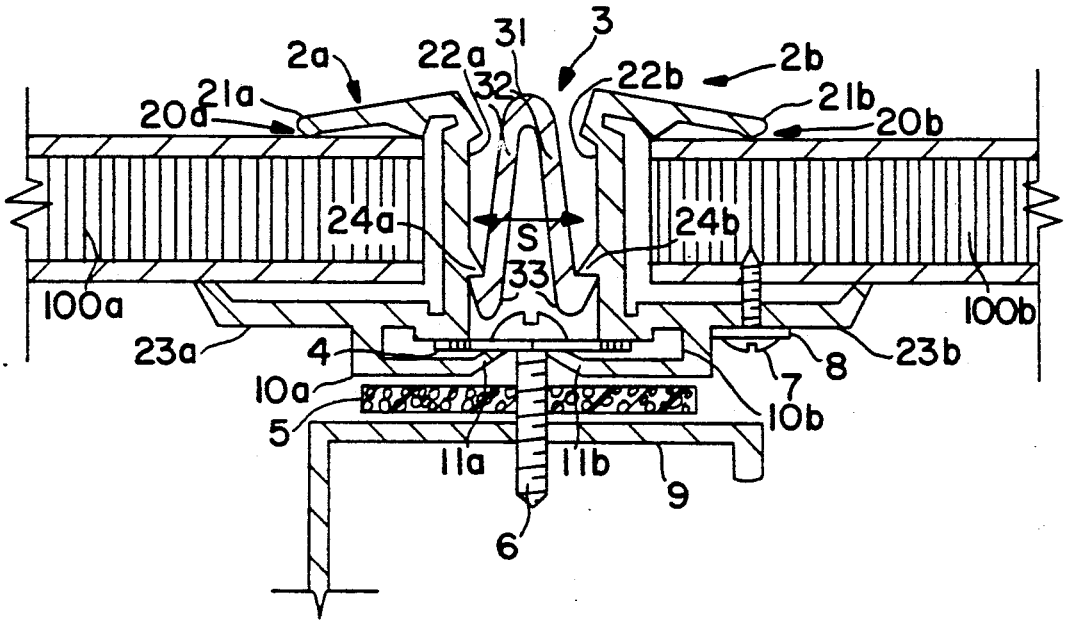
FIG. 2A is a cross-sectional view of an assembly of support members and V-shaped snap-in extruded filler strip for mounting exterior panels in accordance with the present invention.

Referring to FIG. 2A, a channel assembly according to the present invention includes a pair of opposing, extruded support members 2*a*, 2*b* which cooperates with a V-shaped snap-in extruded filler strip 3. The support members 2*a*, 2*b* each has a respective top wall 21*a*, 21*b*, connecting wall 22*a*, 22*b*, and bottom wall 23*a*, 23*b* which define a respective panel holding groove 20*a*, 20*b*. Each support member has its panel holding groove engaged on a peripheral edge of a respective panel 100*a* and 100*b*. The support members are mounted to a building structural member 9 spaced apart from each other by an intermediate space S with the panel holding grooves facing oppositely apart from each other.

The support members each have a linking member 10*a*, 10*b* which extend from the respective bottom member 23*a*, 23*b* so that their ends 11*a*, 11*b* are closely spaced apart from each other. The ends 11*a*, 11*b* of the linking members are secured or clamped in position against the structural member 9 by mounting washers 4 secured by sheet metal screws 6 spaced along the length of the extruded support members. Alternatively, instead of individual washers, the mounting element 4 may be a mounting strip of comparable length as the support members with holes drilled at the time of installation with self-drilling screws. The ends 11*a*, 11*b* of the linking members are angled such that the mounting element 4 can be secured adjustably at different depths to the structural member 9 to accomodate panels of different thicknesses within a given tolerance range, as explained in further detail below.

The support members have respective projections 24*a*, 24*b* on one side of the connecting elements 22*a*, 22*b* facing into the intermediate space S between the adjacent panels 100. The filler strip 3 is dimensioned to be sealingly engaged with the projections 24*a*, 24*b* in the intermediate space S. In the embodiment of FIG. 2A, the filler strip 3 is extruded in a V-shape with a spine portion 31 and a pair of compressible legs 32. The legs 32 each have a foot 33 for engaging with the respective projections 24*a*, 24*b* of the connecting elements 22*a*, 22*b*. The filler strip 3 is made of a material, such as plastic, which has a certain elasticity to allow the legs 32 to be compressed and snapped into engagement with the projections on the sides of the grooves. The connecting elements 22*a*, 22*b* are pushed by the elastic force of the filler strip 3, which pushes the connecting elements 22*a*, 22*b* and top walls 21*a*, 21*b* securely against the surfaces of the exterior panels 100 to form a tight seal therewith. The spine portion 31 also presents an external appearance of a grid or rail which is esthetically attractive, and can be manufactured in any desired color.

When a panel 100 is to be replaced or removed, the filler strip 3 is first removed from the space between two adjacent panels by pushing the legs 32 and disengaging the filler strip 3 from the projections 24*a*, 24*b*. The mounting screw and washer (or strip) is then loosened or removed, so that one or the other support member can be flexibly moved or pivoted to allow the panel 100 to be disengaged from the holding groove without disturbing the other panels.

Figure 2B:
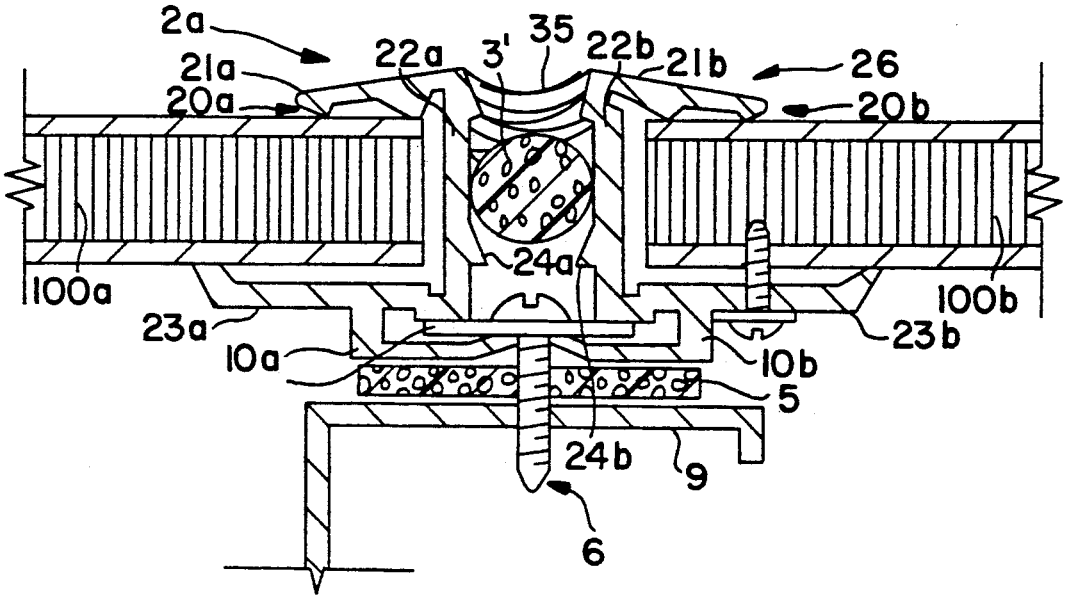
FIG. 2B shows an alternative assembly in which the filler strip is a compressible strip sealed with caulking.

As shown in FIG. 2B, an alternative filler strip arrangement may have a compressible tube or strip 3' which is pushed tightly into the space S between the support members and sealed over with caulking 35. Upon removal, the caulking is stripped from the space, and the strip 3' is removed.

Figure 3:
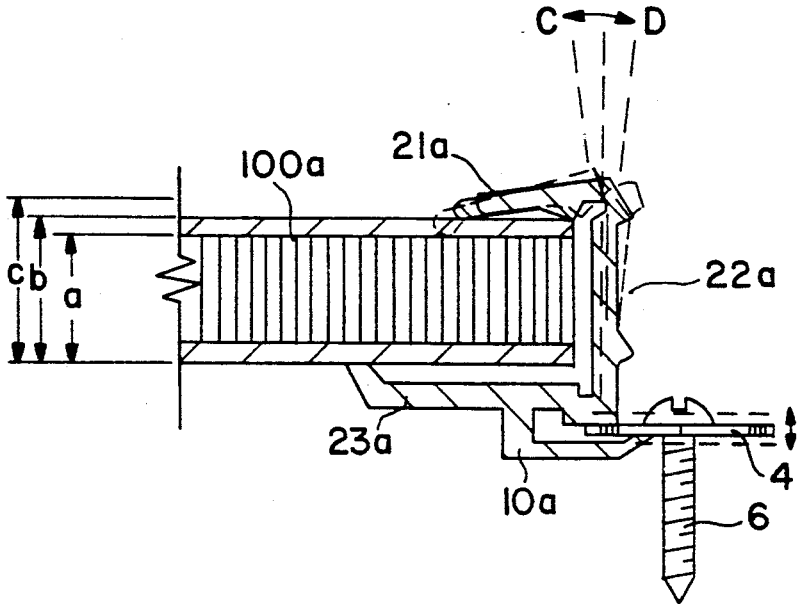
FIG. 3 is a cross-sectional view of a part of the support member showing adjustment of the panel holding portion of the support member to accomodate different thicknesses of the panels.

Referring to FIG. 3, one of the support members 2*a* is shown in further detail. The connecting member 22*a* of the support member is joined at one end to the bottom element 23*a* by a zig-zag or step shape which provides a flexible joint to allow the elements to pivot relative to each other. This flexibility facilitates removal of the panel from the holding groove 20*a*. In addition, the connecting element 22*a* can be flexibly moved in the directions of arrows C and D, by the position of the washer set by the screw 6, in order to allow it and the top wall 21*a* to be moved so as to accomodate variations in the thickness of the panel 100 within a given tolerance range. For example, the top wall 21*a* can be flexed over the range for thickness "a" to "c" encompassing the nominal panel thickness "b". The flexibility of the joint thus allow adjustment for manufacturing tolerances and a buildup of component tolerances.

Referring again to FIG. 2, an elongated mounting strip or ledger 4 may be used in place of individual washers. The mounting ledger 4 is placed over the ends 11*a*, 11*b* of the linking members 10*a*, 10*b*, and an isolation ledger 5 is placed between the lower surfaces of the linking members and the structural member 9 of the building. The mounting and isolation ledgers securely mount the support members 2*a*, 2*b* on the structural member 9, via self-drilling screws 6. The depth of the screws 6 are adjusted so that the mounting ledger 4 abuts the ends of the bottom elements 23*a*, 23*b*, so that the mounting ledger 4 also serves as a sealing member. In addition, the ends 11*a*, 11*b* of the linking members 10*a*, 10*b* are also abutted securely against the bottom surface of the mounting ledger 4, and thus also functions as a sealing member. Accordingly, the structure of the channel assembly of the present invention has the function of triple-redundant seals, in order to prevent water intrusion and corrosion of the panels, the channel assembly, or the structural members of the building.

To further secure the panels in the channel assembly, each panel 100 may have one side edge fixed by a screw 7 and washer 8 to the bottom element of a support member on one side of the mounting assembly. The screw 7 is secured into the back of the panel 100 prior to mounting the support member 2*b* on the structural member 9. For removal of a panel, the mounting screws 6 are removed, and the panel together with the support assembly 2*b* secured thereto ar lifted off from the structural member 9.

Figure 4:
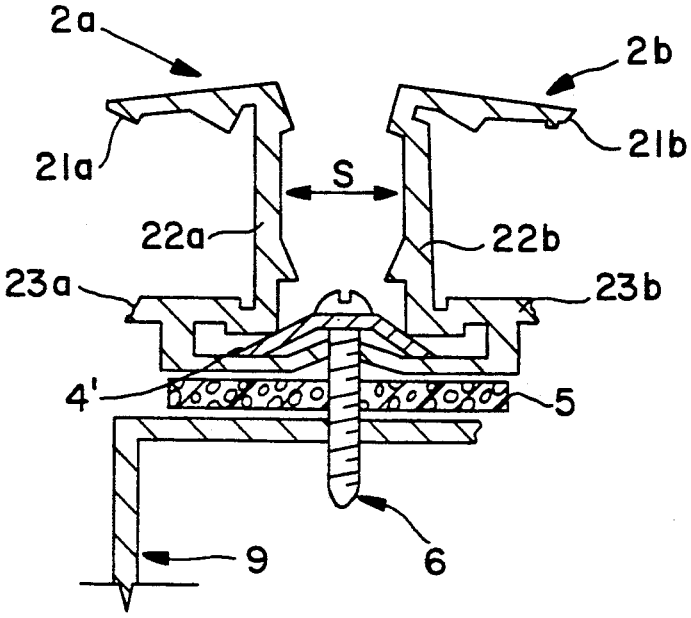
FIG. 4 shows another embodiment in which the mounting element is a Belleville washer and screw arrangement.

In FIG. 4, a further embodiment is shown employing Belleville washers 4' in place of flat steel washers. The Belleville washer has a slightly bevelled or conical shape which gives it a springiness that makes it a better clamp for holding the linking members in place. The bevelled shape also facilitates the abutment of the washer 4' against the joint between the bottom and connecting elements.

As can be seen, the channel assembly of the present invention offers several advantages over the prior art. It satisfies all required characteristics of load carrying, adjustability, sealing, and removability as mentioned previously. It particularly provides a structure of triple-redundant sealing of the separation joints between adjacent panels, to prevent damage due to water intrusion and corrosion. Furthermore, it also allows the support members to be readily installed on the panels and mounted to the structural members of the building, and the exterior panels to be easily removed without having to remove or disturb other panels. It is also economical to manufacture, since the support members and filler strips can be readily formed by extrusion, and also can be made to have an esthetically attractive appearance.

While a preferred embodiment of this invention has been described, it will be understood that various changes and modifications in the materials, structural shapes, arrangements of parts and components may be made without departing from the spirit and scope of the invention, as defined in the following claims.

I claim:

1. A channel assembly for mounting exterior panels on a structural member of a building, comprising:

a pairs of support members each having a panel holding groove formed therein in which a peripheral edge of a respective panel is engaged, said support members being spaced apart by an intermediate space and facing oppositely from each other for supporting the respective exterior panels adjacent each other, each panel holding groove being defined by a top wall, a bottom wall, and a connecting element connected between respective ends of the top and bottom walls, wherein the connecting element of each support member has a projection on one side thereof projecting into the intermediate space between the adjacent panels, and further wherein the bottom wall of each support member has a linking member extending therefrom into the intermediate space and having an end thereof spaced closely adjacent the end of the linking element of the other support member;

mounting means for securing the ends of the linking members of the pair of support members together and mounting them to the structural member of the building; and a filler strip, for sealing the intermediate space between the adjacent panels, having means for elastically engaging the respective projections of the connecting elements of the support members in order to seal the intermediate space and prevent the intrusion of water therein.

2. The channel assembly according to claim 1, wherein the connecting elements of the support members are each connected at one end thereof with the respective bottom wall by a flexible joint connection for adjustably accomodating panels of varying thickness within a tolerance range.

3. The channel assembly according to claim 1, wherein said mounting means are a plurality of individual washers abutting the ends of the linking members and are secured to the structural member of the building by means of screws.

4. The channel assembly of claim 3, wherein said washers having a bevelled shape.

5. The channel assembly of claim 1, wherein said mounting means is a mounting ledger shaped as an elongated strip of a length corresponding to the length of the support members, and is secured in abutment with the ends of the linking members by screws secured to the structural member of the building.

6. The channel assembly of claim 5, further comprising an isolation ledger placed between the linking members and the structural member of the building, wherein said mounting and isolation ledgers are mounted together by self-drilling screws in a redundant sealing engagement with the structural member.

7. The channel assembly of claim 1 wherein each of said panels is secured in the holding groove of one of the support members by fastening means secured through the bottom wall to one side edge at the back of the panel.

8. The channel assembly of claim 1, wherein said filler strip is a V-shaped snap-in extruded filler strip made of plastic material and is formed with a spine portion and a pair of compressible legs, each of which has a foot formed at the end thereof for engaging the respective projections.

9. The channel assembly of claim 1, wherein said filler strip is a compressible strip made of plastic material which is pushed into the intermediate space in resilient abutment with the projections of the support members and sealed therein with caulking.

10. The channel assembly of claim 1, wherein the ends of the linking members are inclined in abutting contact with said mounting means, and said mounting means is positioned in abutment with the support members, so as to form a triply redundant seal in conjunction with said filler strip.

* * * * *